United States Patent [19]

Hein

[11] 4,005,868

[45] Feb. 1, 1977

[54] PUZZLE

[75] Inventor: Piet Hein, Stoke Poges, England

[73] Assignee: Stiftung Fuer Humaniora und Wissenschaft

[22] Filed: June 23, 1975

[21] Appl. No.: 589,635

[30] Foreign Application Priority Data

June 24, 1974 Denmark ..... 3391/74

[52] U.S. Cl. ..... 273/156; 273/130 R; 273/137 D

[51] Int. Cl.[2] ..... A63F 9/06

[58] Field of Search ..... 273/156, 157 R, 137 D, 273/130 R

[56] References Cited

UNITED STATES PATENTS

| | | | |
|---|---|---|---|
| 631,660 | 8/1899 | Patterson | 273/130 R |
| 930,151 | 8/1909 | Brown | 273/130 R |
| 3,608,906 | 9/1971 | Odier | 273/157 R |

OTHER PUBLICATIONS

Scientific American, Nov. 1970, pp. 116, 117.

*Primary Examiner*—Anton O. Oechsle
*Attorney, Agent, or Firm*—Hill, Gross, Simpson, Van Santen, Steadman, Chiara & Simpson

[57] ABSTRACT

A puzzle comprising game board and pieces in which the side surfaces of a regular polyhedron are depicted in spaced relationship on the game board, the vertexes adjoining at a corner of the polyhedron being identified by non-crossing lines from said vertexes to a common point, and in which the pieces are congruent with the depicted side surfaces and have at each vertex an indicium selected from as many different indicia as there are adjoining vertexes at a corner of the polyhedron, said vertex marking being permuted in such a way that none of the pieces are identical. The number of said pieces correspond to the number of side surfaces of the polyhedron in question, and in solving the puzzle the pieces are to be placed covering the depicted polygons of the board, so that none of the markings of the vertexes adjoining at any of said center points are identical.

10 Claims, 12 Drawing Figures

Fig. 5
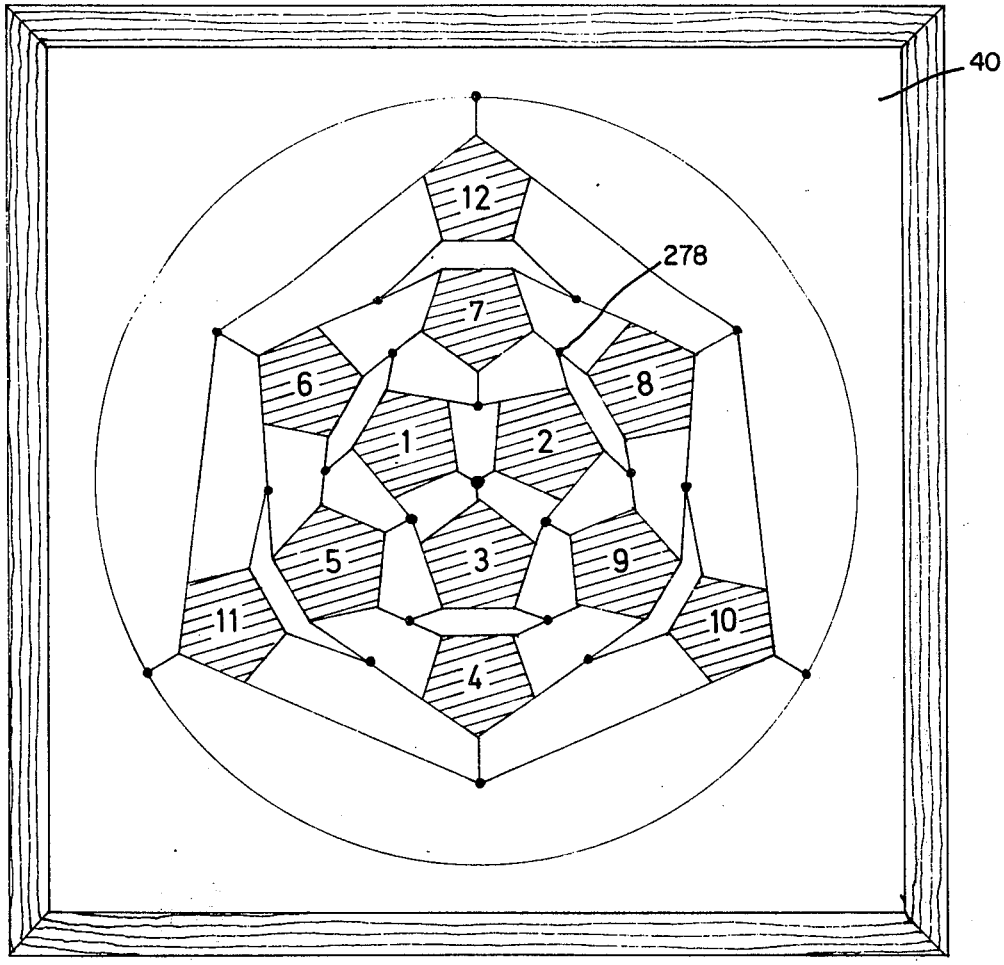
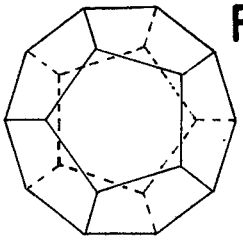
Fig. 5a

Fig. 7
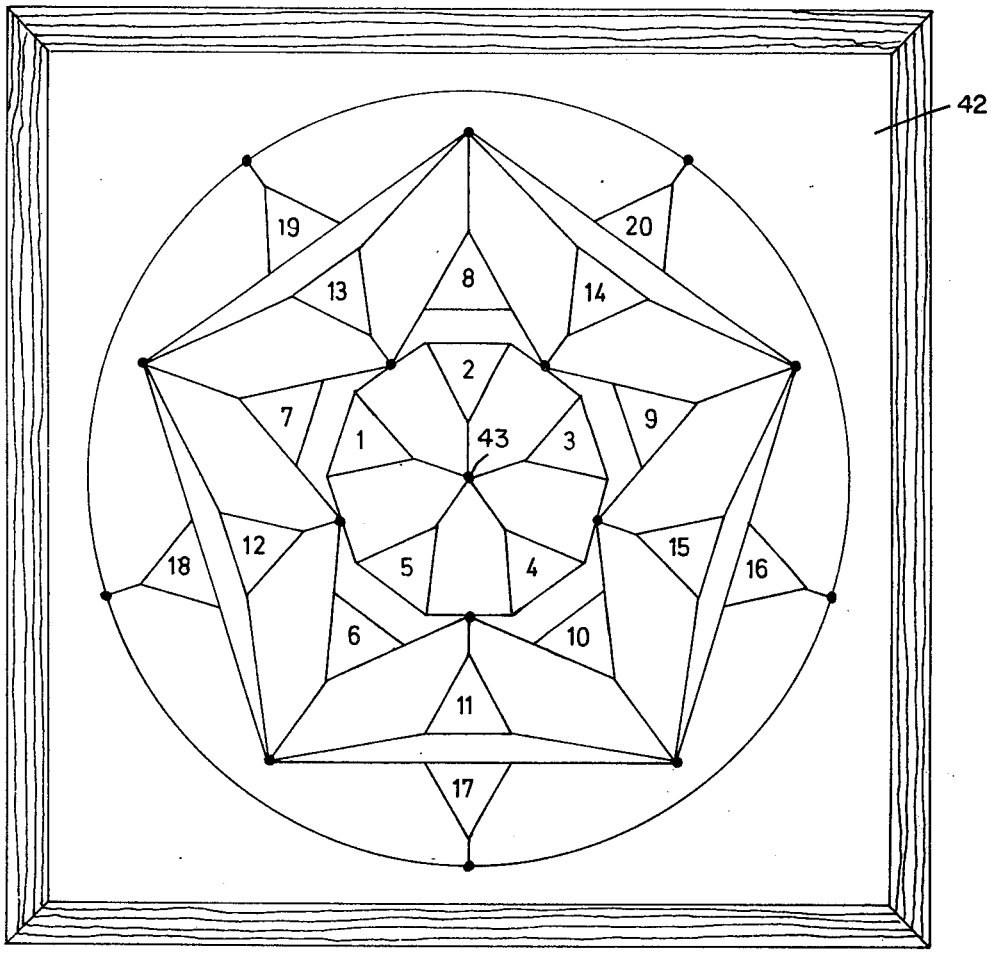
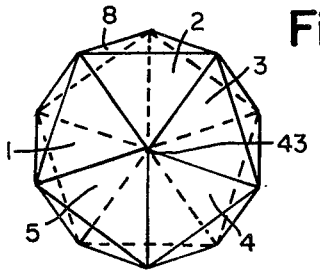
Fig. 7a

PUZZLE

BACKGROUND OF THE INVENTION

1. Field of the Invention

The invention relates to a puzzle of the game board type provided with a set of playing pieces.

2. Prior Art

It has been proposed heretofore, in U.S. Pat. No. 3,608,906, to provide a three-dimensional polyhedron on which are placed playing pieces having a size and shape corresponding substantially to the side surfaces of the polyhedrons. By appropriate indicia provide at each corner of each playing piece, the problem to be solved was that the pieces were to be put onto the polyhedron base in such a manner that all of the vertexes of the playing pieces which adjoin at a corner of the polyhedron are to have the same indicium. This type of construction makes the puzzle relatively easy to solve because the indicia to be matched and their sequence are exactly dictated by a previously placed playing piece.

SUMMARY OF THE INVENTION

The puzzle according to the invention is a game board on which there are representations of the surfaces of a three-dimensional polyhedron. On the game board, these areas are mutually spaced from each other. A plurality of common points are also depicted on the game board, the number of common points corresponding to the number of corners which the polyhedron has, there being a set of lines on the board for each of the common points, each set connecting one of the common points to the vertexes of those geometrical areas which represent a particular group of corner-defining adjoining surfaces of the polyhedron. When the puzzle is given such a construction, it is much less evident to the player what the combination of indicia should be for the next playing piece to be placed. Further, according to the rule of the game, the pieces are to be so placed on the geometrical areas of the game board that all of the vertexes associated with a particular common point are marked differently. Thus, the player cannot unequivocally determine the order of the indicia needed for the next playing piece. As the polyhedron selected to be depicted becomes more complex, the selection of and the combination of indicia to be used is also minimized according to the invention.

ON THE DRAWINGS

FIGS. 3, 5 and 7 are views of second, third and fourth embodiments of the invention;

Figure 3:
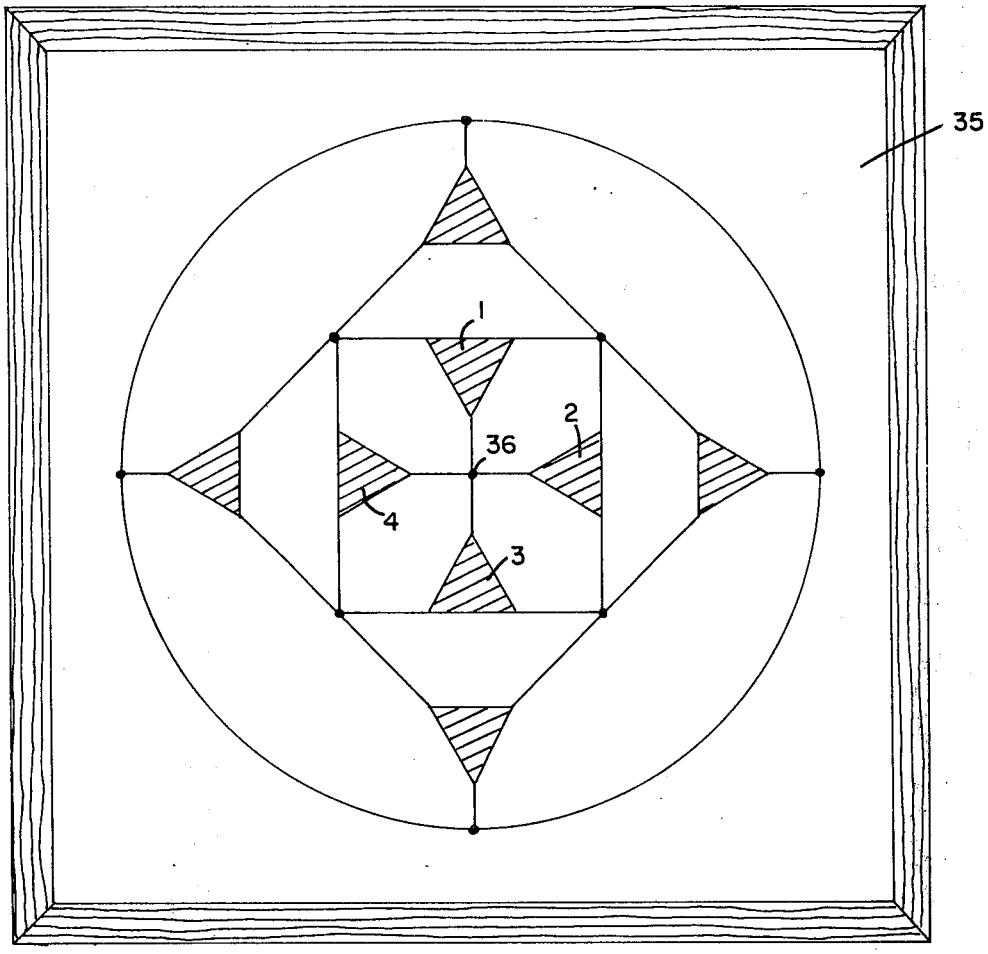
Figure 3A:
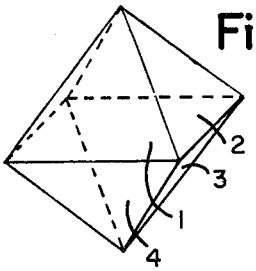
Figure 4:
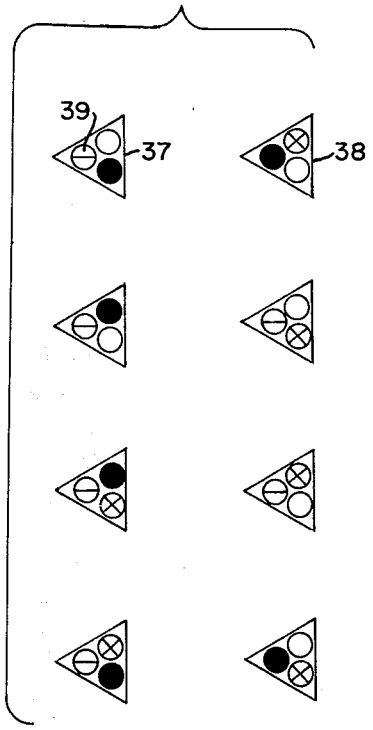
Figure 6:
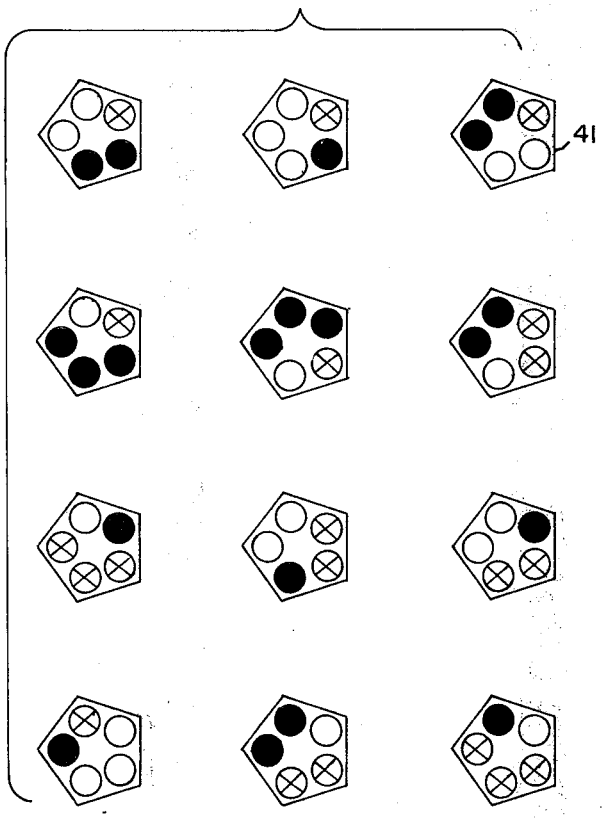
Figure 8:
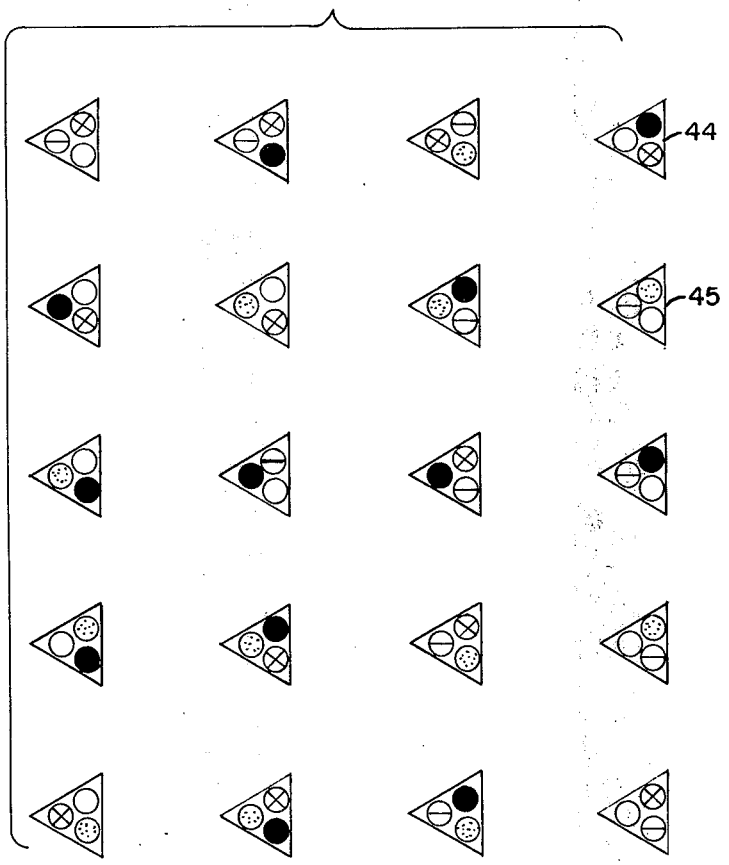

FIGS. 3A, 5A and 7A are diagrams used for explaining FIGS. 3, 5 and 7 respectively; and FIG. 4, 6, and 8 are views of the sets of playing pieces used with the embodiments of FIGS. 3, 5 and 7.

AS SHOWN OF THE DRAWINGS

Figure 1:
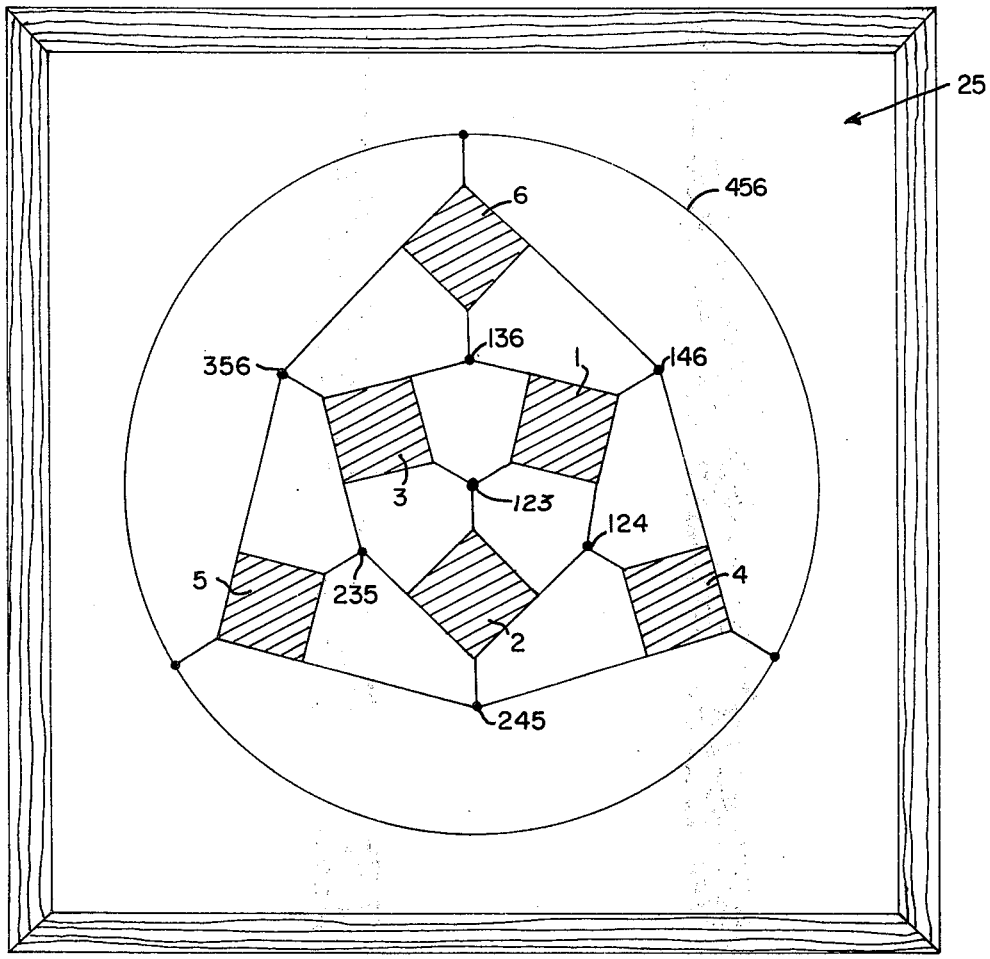
FIG. 1 is a view of a game board provided in accordance with the principles of the present invention.
Figure 1A:
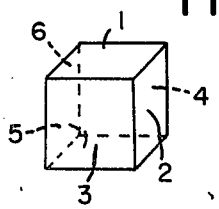
FIG. 1A is a diagram used in explaining FIG. 1.
Figure 2:
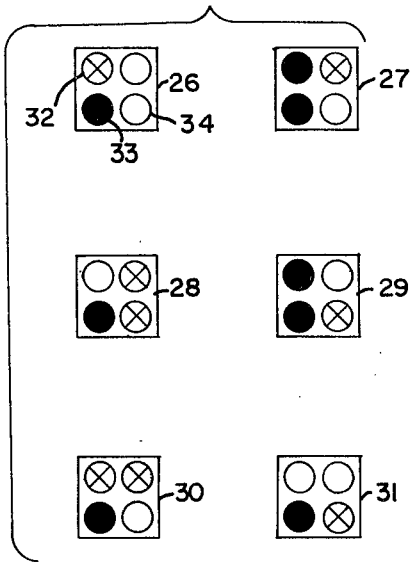
FIG. 2 is a diagram of a set of playing pieces for the embodiment of FIG. 1.

A first embodiment of the invention is illustrated in FIGS. 1 and 2. A game board 25 has a number of geometrical areas 1–6 thereon which are representations of the surfaces of a 3-dimensional polyhedron such as the sides of the cube shown in FIG. 1A. According to the invention, the areas 1–6 are spaced from each other. Remote from the areas 1–6 are a number of common points that are depicted on the board, and the common points correspond in number to the number of corners which the polyhedron, namely the cube has, which in this example is eight. The term "corner" as used herein is defined by the vertexes of adjoining surfaces, designated on the game board as common points 123, 124, 245, 235, 136, 146, 356 and 456. Each of such eight common points is connected by a line to a vertex of the three areas which come together to make the corner that the common point represents. Thus, the common point 123 is connected by lines to the areas 1, 2, 3. Thus, the number of geometrical areas on the game board corresponds to the number of sides on the 3-dimensional polyhedron that is represented, and the number of common points corresponds to the number of corners on such polyhedron. The number of lines from a common point is the same as the number of surfaces that come together to make one of the corners in the diagram of a FIG. 1A.

With the game board 25, there is provided a set of playing pieces, all of which are illustrated in FIG. 2. The number of playing pieces corresponds to the number of geometrical areas, and preferably corresponds also in shape to such areas. There is an indicium at each vertex of each playing piece and the total number of indicia that are utilized is the same as the number of surfaces that meet at a corner in FIG. 1A, which can be stated as being the number of lines that emanate on the game board from one of the common points. In the set shown in FIG. 2, each playing piece has four indicia because there are four vertexes, but as only three indicia are used in the set, one of them is repeated in an adjacent vertex. Each of the playing pieces 26–31 differs from each other as to the indicia 32–34 carried thereon, the playing piece 26 having the indicium 34 present in two adjacent vertexes.

In playing the game or solving the puzzle, the player has a choice of which playing piece to place on which area and also has a choice of four relative positions on a given space. The object of the puzzle is to place all of the playing pieces 26–31 on the geometrical areas 1–6 such that the lines from each one of the common points leads to dissimilar indicia.

Preferably, the areas 1–6 have shapes that are identical to each other, even though they are represented in a single plane. Further, it is preferable that each of the common points is spaced from all of such areas.

A second embodiment of the invention is shown in FIGS. 3 and 4. A game board 35 has 12 geometrical areas such as 1–4 representing 12 sides of an octahedron diagrammed in FIG. 3A. The octahedron has eight corners and therefore there are eight common points such as 36 depicted on the game board 35. As there are four surfaces that meet at a corner in FIG. 3A, there are four lines that extend from each common point such as 36 to four of the areas such as 1–4, and as there are eight areas, there are eight playing pieces such as shown in FIG. 4. As there are four surfaces that meet at one corner, there are four different indicia used in the set, such as the same three indicia used in the playing piece 38 while the playing piece 37 has an additional type of indicium 39. Although there are more than three different indicia in the set, there are only three different indicia used on any one of the pieces 37, 38. The rule of play for all of the embodiments is the same.

A third embodiment is shown in FIGS. 5 and 6 where a game board 40 represents a dodecahedron diagrammed in FIG. 5A which has twelve geometrical areas numbered 1–12 in FIG. 5. The numbers 1–12 shown in FIG. 5 may be indicia carried on the game board which can be used in connection with explaining separate written solutions. The 12 pieces that make up the playing set are shown in FIG. 6, such as the playing piece 41. Each of the pieces in this set has five indicia because the playing pieces are shaped as pentagons. However, as only three surfaces join to make a corner in the diagram of FIG. 5A, only three different indicia are used. Thus, as shown in FIG. 6, all three of those indicia are present on each playing piece, with one of the indicia appearing at three of the adjacent vertexes in certain of the pieces, and with two of the indicia repeated once in an adjacent vertex as shown for the piece 41. Thus, even though there are more than four vertexes, only three different indicia are used on any one playing piece. Thus, two of the adjacent vertexes in the playing piece 41 have the same indicia, while in other pieces of this set, three of the adjacent vertexes have the same indicia. In no instance is the same indicium used at all of the vertexes. Yet, like the other sets described, no two playing pieces are alike, even though their size and shape are identical. As there are 20 corners in the diagram of FIG. 5A, there are 20 common points such as 278 depicted on the game board 40.

FIGS. 7 and 8 show a fourth embodiment of the invention that includes a game board 42 and a set of 20 playing pieces 44, 45. The polyhedron that is represented on the game board 42 is shown diagrammatically in FIG. 7A, it being an icosahedron. As an icosahedron has 20 surfaces, there are 20 triangular areas 1–20 depicted on the game board 42 but if desired, the numberings on those areas may constitute actual indicia on the game board. The number of surfaces that meet at a corner in the diagram of FIG. 7A is 5, and therefore, each of the common points such as 43 is connected to five of the areas such as 1–5, and five different indicia are used on the playing pieces such as 44 and 45. As there are 12 corners on the polyhedron of FIG. 7A, there are 12 common points on the game board 42. Although there are five different indicia used in the set of FIG. 8, only three different ones appear on any one of the pieces, and each of the pieces differs from the others, even though it has the same shape and size.

In order to facilitate the solving of the problem, the back of the pieces may be provided with numbers, corresponding to that of the correct geometrical area shown in FIGS. 5 and 7, so that the placing of the pieces in relation to each other is determined. Then the problem remaining is limited to finding the correct angular position of the pieces.

The indicia used on the various sets of playing pieces are purely illustrative and other indicia or codes may be utilized.

I claim as my invention:

1. A puzzle comprising:

a. a game board having geometrical areas thereon which are representations of the surfaces of a three-dimensional polyhedron, said areas being mutually spaced from each other, said board having a plurality of common points depicted thereon corresponding in number to the number of corners which the polyhedron has that are defined by the vertexes of adjoining surfaces, a set of lines on said board for each of said common points, each set connecting one said common point to the vertexes of those geometrical areas which represent a particular group of corner-defining adjoining surfaces of the polyhedron; and b. a set of playing pieces, corresponding in number and in shape to said areas, each said playing piece having on one said an indicium at each vertex, each indicium being one of a number of different indicia which number corresponds to the number of surfaces meeting at one of the corners of the polyhedron, the indicia on each said piece being so combined that none of the pieces are identical.

2. A puzzle according to claim 1 in which said areas have identical shapes.

3. A puzzle according to claim 1 in which said common points are spaced from said areas.

4. A puzzle according to claim 1 in which, when said pieces are properly placed on said areas, all of said indicia associated by one of said sets of lines with one of said common points are different from each other.

5. A puzzle according to claim 1 in which said set of pieces has more than three different indicia, there being only three different indicia on any one of said pieces.

6. A puzzle according to claim 1 in which said playing pieces have more than four vertexes, there being only three different indicia on any one of said pieces.

7. A puzzle according to claim 1 in which at least two but less than all of the adjacent vertexes of all of said pieces have the same indicium.

8. A puzzle according to claim 1 in which said pieces are triangular, and each has three different indicia, there being at least four different indicia used in said set.

9. A puzzle according to claim 1 in which said spaces represent the surfaces of a icosahedron.

10. A puzzle according to claim 1 in which said spaces represent the surfaces of an octahedron.

* * * * *